US008888051B2

(12) United States Patent
Mardirossian

(10) Patent No.: US 8,888,051 B2
(45) Date of Patent: Nov. 18, 2014

(54) TRAIN CROSSING SAFETY SYSTEM

(75) Inventor: Aris Mardirossian, Germantown, MD (US)

(73) Assignee: Seastheday, LLC, Venice, FL (US)

( * ) Notice: Subject to any disclaimer, the term of this patent is extended or adjusted under 35 U.S.C. 154(b) by 1366 days.

(21) Appl. No.: 11/526,247

(22) Filed: Sep. 25, 2006

(65) Prior Publication Data

US 2008/0073466 A1 Mar. 27, 2008

(51) Int. Cl.
*B61L 23/00* (2006.01)
*B61L 29/30* (2006.01)

(52) U.S. Cl.
CPC ..... *B61L 29/30* (2013.01)
USPC ..... 246/111

(58) Field of Classification Search
USPC ..... 246/23, 24, 111, 114 R, 115
See application file for complete search history.

(56) References Cited

U.S. PATENT DOCUMENTS 5,474,266 A 12/1995 Koglin
5,729,213 A 3/1998 Ferrari et al.
5,825,412 A * 10/1998 Hobson et al. ..... 348/149
6,163,755 A * 12/2000 Peer et al. ..... 701/301
6,532,038 B1 3/2003 Haring et al.
6,865,454 B2 * 3/2005 Kane et al. ..... 701/19
7,688,222 B2 * 3/2010 Peddie et al. ..... 340/905

* cited by examiner

*Primary Examiner* — R. J. McCarry, Jr.
(74) *Attorney, Agent, or Firm* — Nixon & Vanderhye PC

(57) ABSTRACT

Systems and/or methods for reducing problems associated with the train/railroad systems are provided. In certain example embodiments, a system and/or method is provided wherein a sensor monitors a particular area (e.g. a train/railroad crossing, a tunnel entrance or exit, etc.) and transmits data (e.g. an image and/or video) to a train as it approaches the monitored area (e.g. when it is within a predetermined distance of the monitored area). In certain example embodiments, the sensor may be enclosed within a housing to prevent damage thereto. A display within the train may indicate whether or not there is a problem at the particular monitored area (e.g. a blockage at a crossing, a cave-in at a tunnel, etc.). Multiple images corresponding to multiple areas may be displayed, and may be ordered, for example, to the train. The conductor of the train may take appropriate action to avoid accidents and/or to reduce the impact of inevitable accidents (e.g., by stopping the train or reducing speed).

19 Claims, 7 Drawing Sheets

TRAIN CROSSING SAFETY SYSTEM

FIELD OF THE INVENTION

Certain example embodiments of this invention relate to systems and/or methods for reducing the dangers associated with railroad and/or train system(s). In certain example embodiments of this invention, a system and/or method is provided wherein a sensor is operable to monitor a particular area (e.g. a railroad crossing, train crossing, a tunnel entrance or exit, etc.) and transmit data to a train as it approaches the area (e.g., when the train is within a predetermined distance of the area). A display within the train may indicate that there is a problem at the particular area (e.g., a blockage at a crossing, a cave-in at a tunnel, a car stopped on the tracks, etc.). The conductor of the train may then take an appropriate action to avoid an accident (e.g., by switching tracks) and/or to reduce the impact of an inevitable accident (e.g. by reducing speed and/or braking).

BACKGROUND AND SUMMARY OF EXAMPLE EMBODIMENTS OF THE INVENTION

The system of trains/railroads has played an integral part in the development of industry in the United States. Growth of the railway system in the United States was rapid, with the total mileage increasing from 9,021 miles in 1850 to 129,774 miles in 1890. Throughout the nation's formative years, such growth enabled the quick, energy efficient transport of goods and passengers. More recently, and in addition to the railroad system's importance to the growth of industry in America, electric railways have revolutionized urban transport, while diesel powered locomotives remain an important vehicle for hauling freight. And traditional passenger trains still remain a primary option for travel, even over long distances, in the U.S. and in many parts of the world.

However, railroads also have been dangerous. There are several reasons why trains are dangerous, for example, relating to the high speed at which they travel, their heavy weights, their inability to deviate from a track, and the great distances they may require to stop safely. Possibilities for accidents include derailments (e.g. jumping the track), head-on collisions with trains coming the opposite directions, and collisions with vehicles at a level crossing (also sometimes referred to as a grade crossing) where a road or path crosses the train track. Accordingly, several safety measures have been put into place. Common conventional examples of safety measures include railway signals and gates at level crossings. Train whistles are designed to warn others of the presence of a train, and trackside signals are designed to maintain the distances between trains.

Unfortunately, level crossing collisions are relatively common in the United States. Indeed, each year, several thousand level crossing collisions kill about 500 people. Furthermore, according to the Department of Transportation, there are about 1,000 rail-related fatalities each year. On Jan. 26, 2005, what originally was thought to be a failed suicide attempt by an automobile driver caused a southbound Metrolink double-deck commuter train to collide with a vehicle that had been driven onto the tracks in California. The collision caused the train to derail and strike the northbound Metrolink train on the other mainline track, as well as a parked Union Pacific Railroad freight train on a side. Eleven people were killed, and about 100 more were injured. A Murray County, Ga. school bus collided with a CSXT freight train, killing three and injuring four in 2000. As a final example, in the Bourbonnais train accident in 1999, a southbound Amtrak City of New Orleans hit a semi truck loaded with steel rebar at a grade crossing. The derailment and ensuing fire spread to a Superliner sleeper train. The entire acceded resulted in 11 fatalities and over 100 injuries.

While these accidents are indeed tragic, rail-related accidents have the potential to spread beyond the immediately surrounding and/or involved trains, cars, etc., resulting in harms apart from, or in addition to, the original collision or derailment. For example, in 2002, a train derailment near a residential area west of Minot, N. Dak. resulted in a major chemical leak. Seven of fifteen tank cars ruptured, releasing more than 200,000 gallons of anhydrous ammonia which vaporized in the sub-zero air, forming a toxic cloud that drifted over much of Minot. One man died and numerous others were treated for chemical exposure. A runaway train carrying lumber derailed in an L.A. suburb, destroying several homes and rupturing natural gas lines in 2003. In 2001, a 60-car CSX train carrying chemicals and wood products derailed in a tunnel under Baltimore, causing a fire that burned for six days and water contamination.

Thus, it will be appreciated that there is a need for a system and/or method for reducing the dangers associated with the train/railroad system. Accordingly, in certain example embodiments, a system for reducing problems associated with a railroad system is provided. Such systems may comprise at least one sensor operable to gather condition data related to at least one monitored area (e.g., at a crossing), each sensor being associated with at least one monitored area. Each sensor may have an associated first communicator configured to communicate with one or more second communicator(s). Each second communicator may be located on an associated train. Each train may include a display operable to display condition data received by the second communicator associated with the train.

In certain example embodiments, a method for reducing problems associated with a railroad system is provided. Such methods may comprise gathering condition data for at least one monitored area. The condition data may be sent to any trains within a receiving range. When a train is within a receiving range of the condition data, the condition data may be received by the train. The condition data may be displayed on the train based on a predetermined criteria.

According to certain example embodiments, each sensor may be operable to gather condition data comprising a video, an image, and/or a temperature of the monitored area. Each sensor also may be operable to gather condition data at predetermined time intervals. The condition data may further comprise a date and/or time associated with when the condition data was gathered, and an identifier for identifying the monitored area.

According to certain example embodiments, each train may further include a unit operable to determine a location and/or speed at which the train is traveling. This unit may be a GPS unit. According to an example embodiment, a processor may be operable to filter condition data based on a location of the train relative to the monitored area and/or a determination of when the train is scheduled to reach the monitored area. A processor may be operable to order condition data received from two or more sensors based on a location of the train relative to the monitored area and/or a determination of when the train is scheduled to reach the monitored area.

Certain example embodiments may comprise a second display located proximate to the monitored area, being operable to display a time at which a train will arrive at the monitored area, a length of time during which the train will be passing through the monitored area, and/or a countdown until the train will arrive at the monitored area. This may allow, for example, pedestrians and/or vehicle drivers at a train/road crossing to know how much time they have until the inbound train arrives at the crossing.

In certain example embodiments, each first communicator and each second communicator may be wireless communicators. Certain example embodiments may further comprise a central safety station operable to communicate with each first communicator and each second communicator.

BRIEF DESCRIPTION OF THE DRAWINGS

These and other features and advantages will be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
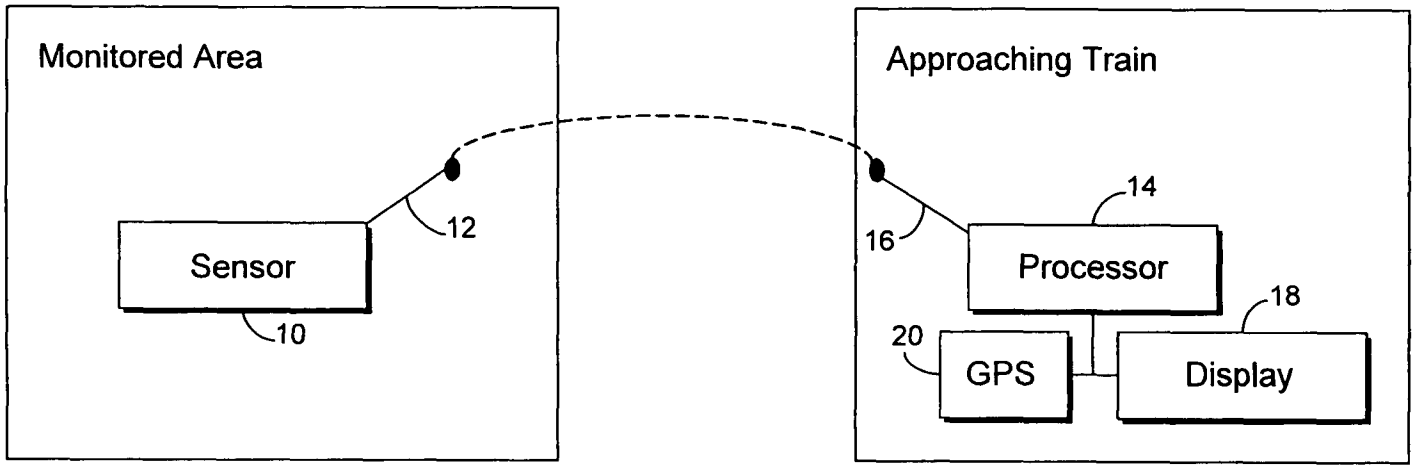
FIG. 1 is a partial schematic view of a system for monitoring an area of a railway in accordance with an example embodiment.

Referring now more particularly to the drawings in which like reference numerals indicate like parts throughout the several views, FIG. 1 is a partial schematic view of a system for monitoring an area of a railway in accordance with an example embodiment. In FIG. 1, sensor 10 is located in or proximate to a monitored area. In general, a monitored area may be any area where, or proximate to where, a train may travel. Thus, a monitored area may be, for example, a railroad crossing, a tunnel entrance or exit, etc., as well as the surrounding areas. Sensor 10 may observe the area and gather information related to the condition thereof. An illustrative condition data transmission will be described in greater detail below with reference to FIG. 5. For example, sensor 10 may take videos with or without sound, capture still images (e.g. at predetermined time intervals, when motion is detected, etc.), gather information relating to weights of objects located on tracks, etc. Videos may be substantially continuous, or they may be captured at predetermined time intervals, etc.

Optionally, sensor 10 may be positioned in a protective casing (not shown). The protective casing may prevent damage to the sensor 10 as a result of, for example, vandalism, exposure to the elements, etc. Also, the protective casing may be a cage, transparent container, or the like. It will be appreciated that the protective casing should be disposed so as to avoid interfering with the operation of sensor 10 and its associated components.

First communicator 12 may be operably connected to sensor 10. First communicator 12 may transmit condition data relating to the monitored area to a train (e.g. an approaching train). For example, condition data may be wirelessly broadcasted for any trains within a receiving distance. It will be appreciated that condition data sent by first communicator 12 may be sent in others ways, in the alternative and/or to provide redundant communications functions. For example, condition data may be sent through a wired connection, by using conductive rails as transmitters, etc. Also, condition data may be sent to a given train directly (e.g. an approaching train due at a known time, etc.) rather than being simply broadcasted for any train that may be within a receiving distance. For example, even though elevated trains may be spatially proximate to trains passing under them, the elevated trains may not benefit from condition data from the lower trains. Conversely, though, lower trains may be sent condition data associated with the elevated train because, for example, a collapsed bridge certainly would affect any rails below the bridge.

An approaching train may receive condition data via a suitably configured second communicator 16 operably connected to processor 14. Processor 14 may, in turn, process the received condition data. By way of example and without limitation, processor 14 may filter the data based on the train's distance to the monitored area, the time it will take to reach the monitored area, the location of the monitored area, etc. Also, by way of example and without limitation, far away areas may and/or areas that may take a long time to reach the monitored area need not be processed immediately. Similarly, if a train is traveling on a separate track that is not affected by a monitored area, processor 14 need not immediately process the condition data. Processor 14 may obtain position and/or speed data associated with the train from a suitable configured GPS unit 20, and a simple speed/distance calculation may indicate an estimated time of arrival at a monitored location.

Display 18 also may be operably connected to processor 14. Display 18 may display information corresponding to the condition data gathered by sensor 10 at the monitored area, including any videos, images (static, updating, or the like), etc. Display 18 also may show other information, such as, for example, the date and/or time the condition data was captured, the ETA for a monitored area, the time at which the train will be clear of the area, etc. An illustrative display 18 is described in greater detail below with reference to FIG. 6*a*.

It will be appreciated that an alert system (not shown) also may be operably connected to processor 14. Such an alert system may include audio alerts, flashing lights, etc. to alert a train's conductor of an upcoming problem. Additionally, processor 14 may be operably connected to a control system of the train (not shown). According to such an example embodiment, then, processor 14 may automatically instruct the train, for example, to reduce speed, etc. if a problem is detected. It will be appreciated that such example embodiments may implement computer vision techniques, motion sensing techniques, etc. to determine whether a problem exists and to determine an appropriate reaction to a detected problem. Alternatively, or in addition, processor 14 may suggest one or more mitigation plans (e.g. reducing speed, switching tracks, etc.), for the train's conductor to evaluate and enact if a problem is found.

Optionally, the monitored area may include a second display (not shown). The second display may, for example, indicate a time at which the approaching train will reach the monitored area, an amount of time that the train will be passing through the area, etc. Such times may be reflected as absolute times of the day, countdowns, etc.

Figure 2:
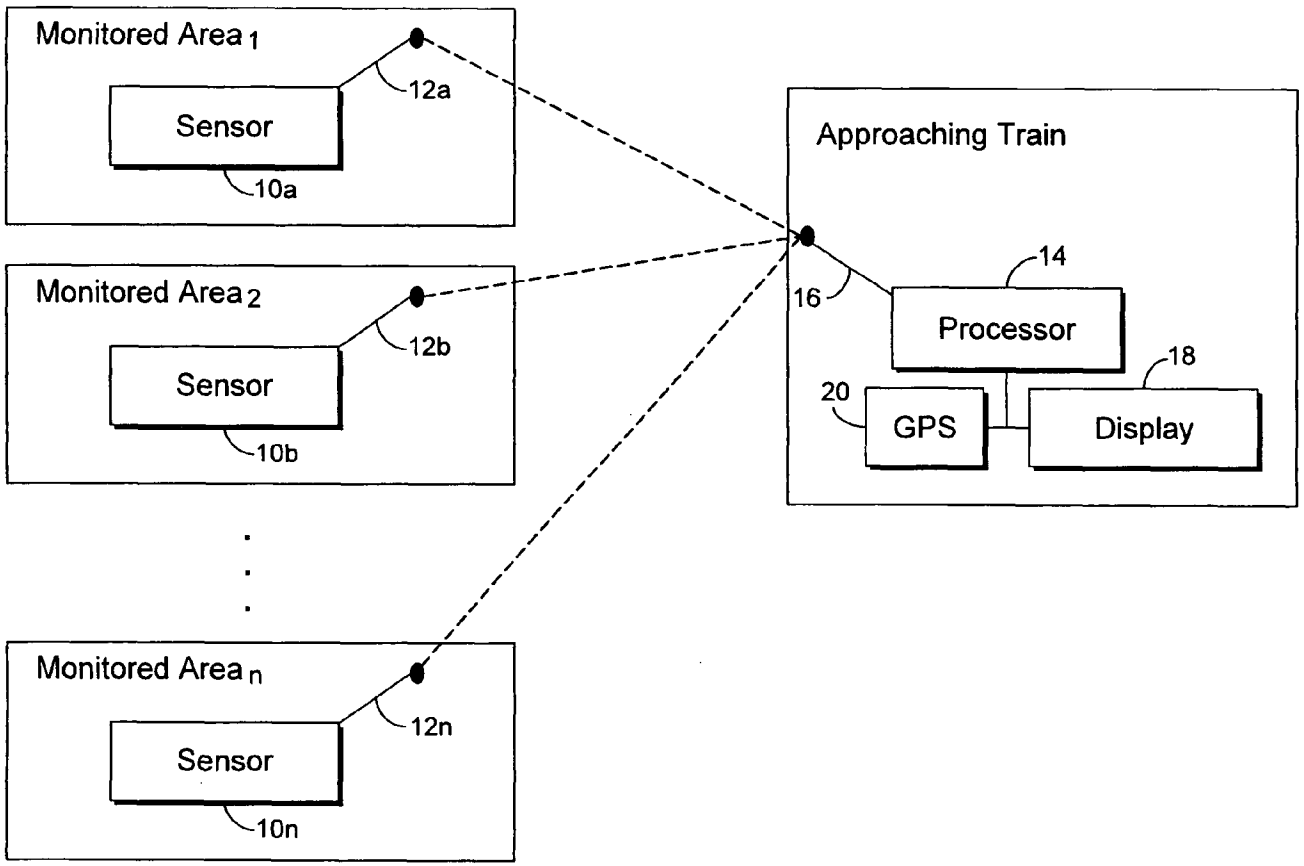
FIG. 2 is a partial schematic view of a system for monitoring multiple areas of a railway in accordance with an example embodiment.

FIG. 2 is a partial schematic view of a system for monitoring multiple areas of a railway in accordance with an example embodiment. FIG. 2 is like FIG. 1, except it shows an example embodiment capable of monitoring a number of monitored $areas_{1-n}$. Thus, if multiple monitored $areas_{1-n}$ having sensors 10*a-n* are in operable communication with the approaching train via first communicators 12*a-n*, display 18 of the approaching train, based on, for example, instructions by processor 14, may display condition data associated with each monitored area. For example, condition data corresponding to multiple locations may be displayed in a rotating manner. Alternatively or in addition to the rotations, the display may be partitioned into sections, with data received from a single sensor 10 being displayed in a single section. In these cases, condition data may be ordered, for example, based on the estimated time of arrival at each monitored area, the distance to each monitored area, etc. An illustrative display 18 having partitions is described in greater detail below with reference to FIG. 6*b*. It will be appreciated that these types of displays may be used in connection with example embodiments where multiple sensors 10*a-n* are disposed within or proximate to a single monitored area.

Figure 3:
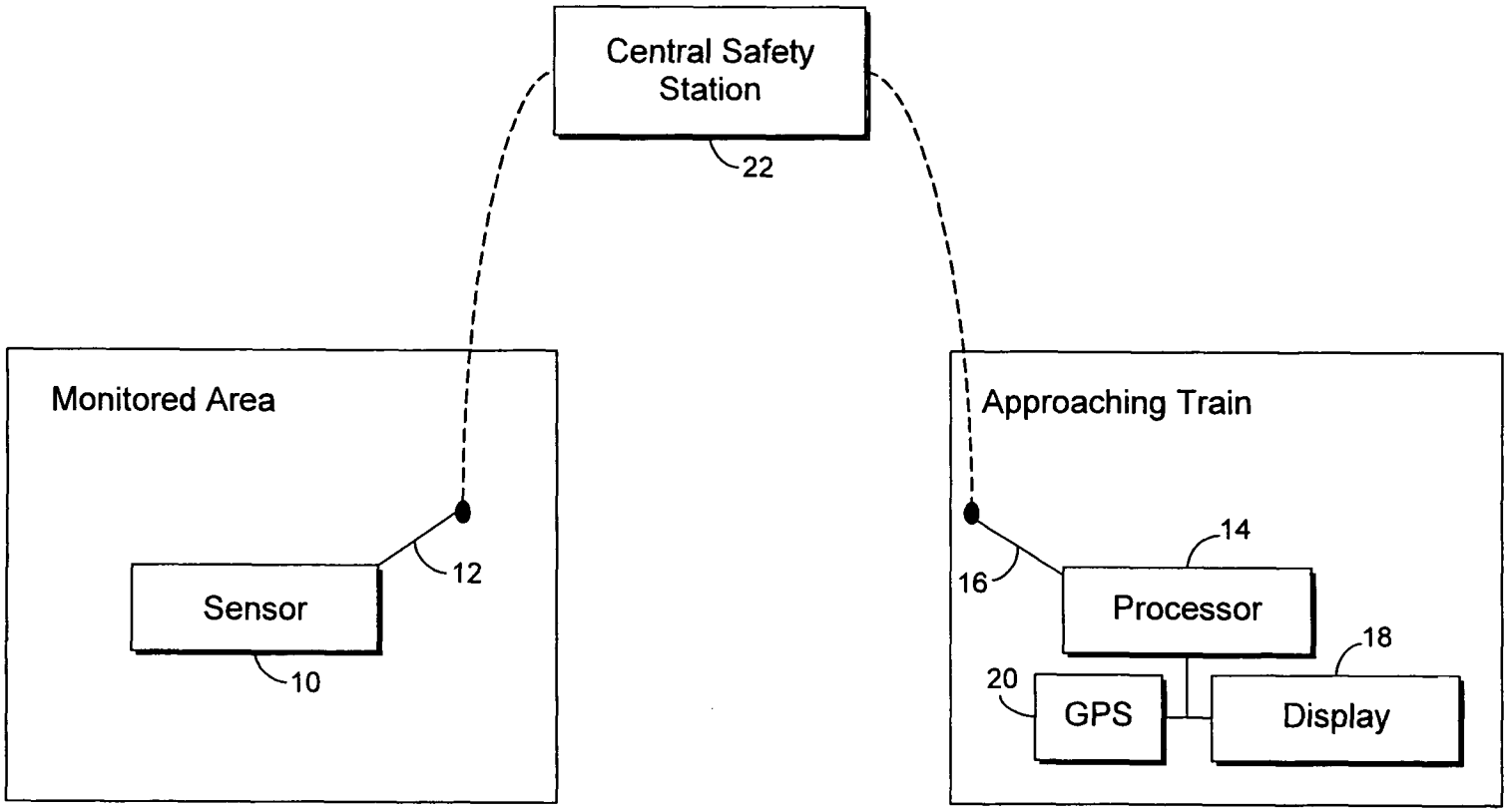
FIG. 3 is a partial schematic view of a system including a central safety station for monitoring an area of a railway in accordance with an example embodiment.

FIG. 3 is a partial schematic view of a system including a central safety station 22 for monitoring an area of a railway in accordance with an example embodiment. FIG. 3 is like FIG. 1, except it shows communications between first communicator 12 and second communicator 16 being mediated by central safety station 22. In certain example embodiments, central safety station 22 may receive condition data from a monitored area. Based on, for example, a location of a train, an estimated time of arrival at the monitored area, etc. (e.g. as reported by GPS unit 20 on board the train, as computed by central safety station 22, etc.), central safety station 22 may selectively relay the condition data to approaching trains. Central safety station 22 also may be operably configured to broadcast general alerts to trains (e.g. weather information, threat advisory levels, etc.), specific information as to the status of trains to the public, etc.

Figure 4:
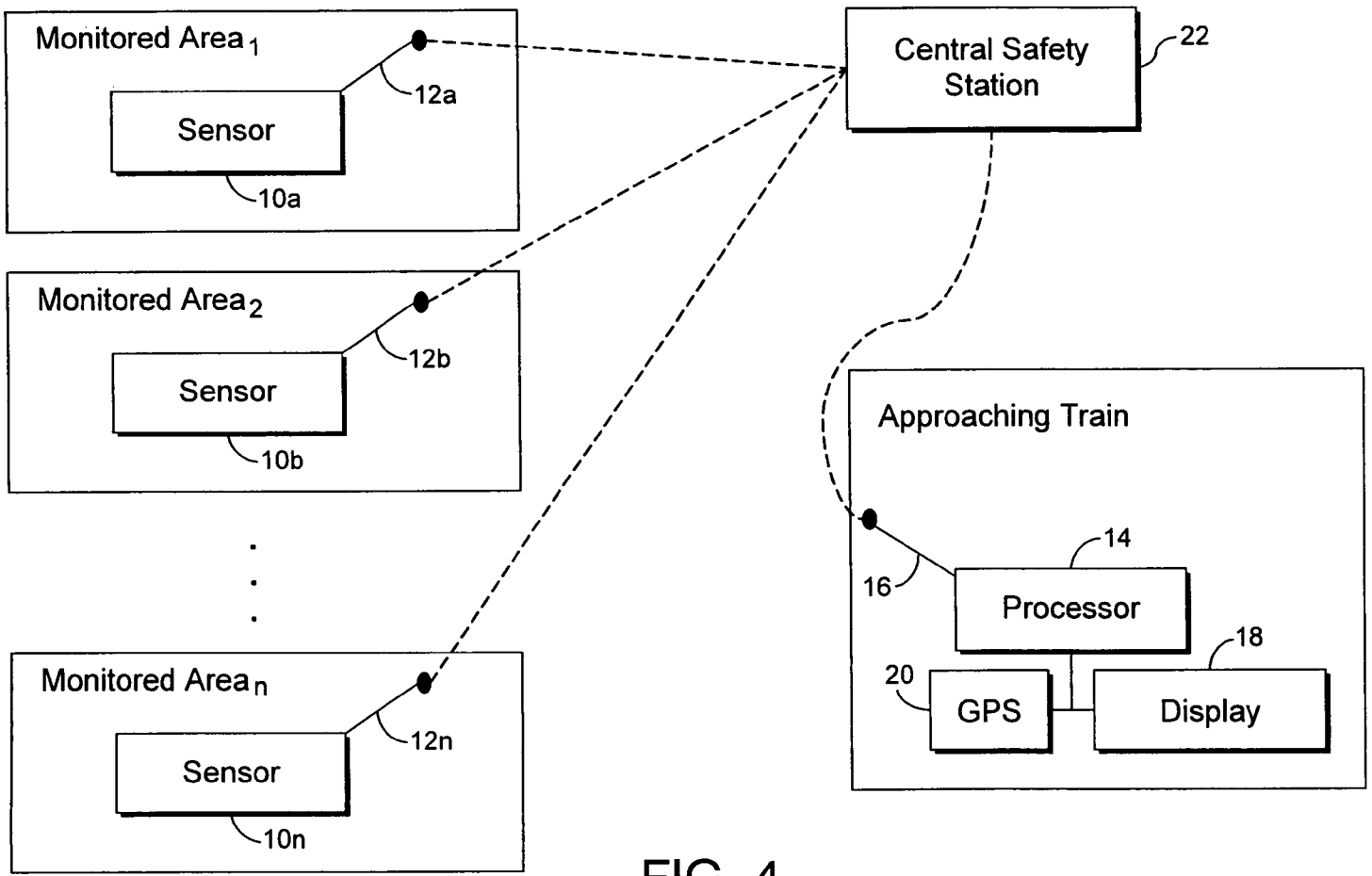
FIG. 4 is a partial schematic view of a system including a central safety station for monitoring an area of a railway in accordance with an example embodiment.

FIG. 4 is a partial schematic view of a system including a central safety station 22 for monitoring an area of a railway in accordance with an example embodiment. FIG. 4 is like FIG. 2, except it also shows central safety station 22 explained in connection with FIG. 3. In FIG. 4, central safety station 22 additionally may maintain a central database storing, for example, condition data associated with multiple sensors 10*a-n* at different monitored areas or within a single monitored area, etc.

Figure 5:
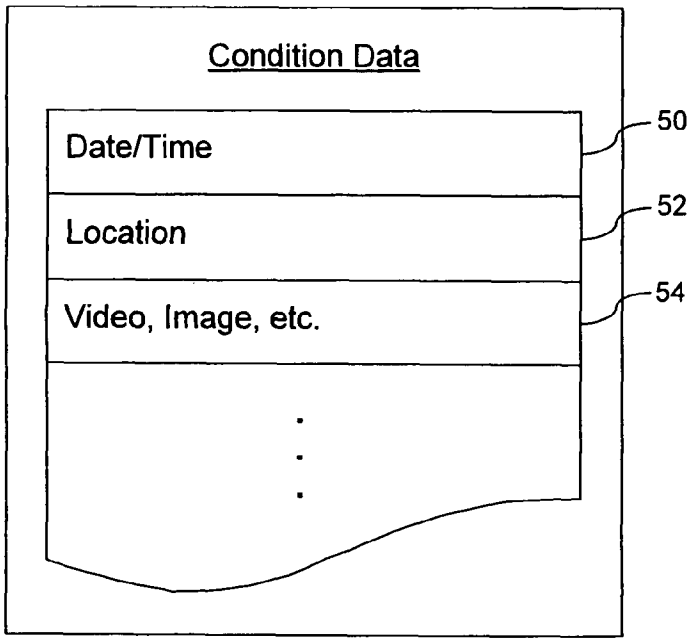
FIG. 5 shows illustrative condition data associated with a monitored area of a railway in accordance with an example embodiment.

FIG. 5 shows illustrative condition data associated with a monitored area of a railway in accordance with an example embodiment. Area 50 includes data associated with the date and/or time at which the condition of the monitored area was observed. Area 52 identifies the location. For example, a unique identifier (e.g. a unique alphanumeric identifier) may be associated with each monitored location, and/or each sensor within a monitored area, to facilitate filtering by a train's processor 14. Area 54 includes the data to be displayed. Thus, if a monitored area's sensor 10 includes a camera configured to capture a video, area 54 may include a video file in any suitable format, such as, for example, AVI, MPEG, RealMedia, QuickTime, WMV, etc. Similarly, if a monitored area's sensor 10 includes a camera configured to capture still images, area 54 may include a picture file in any suitable format, such as, for example, a JPEG, GIF, TIFF, BMP, etc. It will be appreciated that information included in area 54 may include other data, and it will be appreciated that the types of information and formats thereof listed above are given by way of example and without limitation. It also will be appreciated that the condition data may be compressed, in whole or in part, to facilitate its transmission (e.g. between first communicator 12 and second communicator 16, from and/or to central safety station 22 when appropriate, etc.).

Figure 6A:
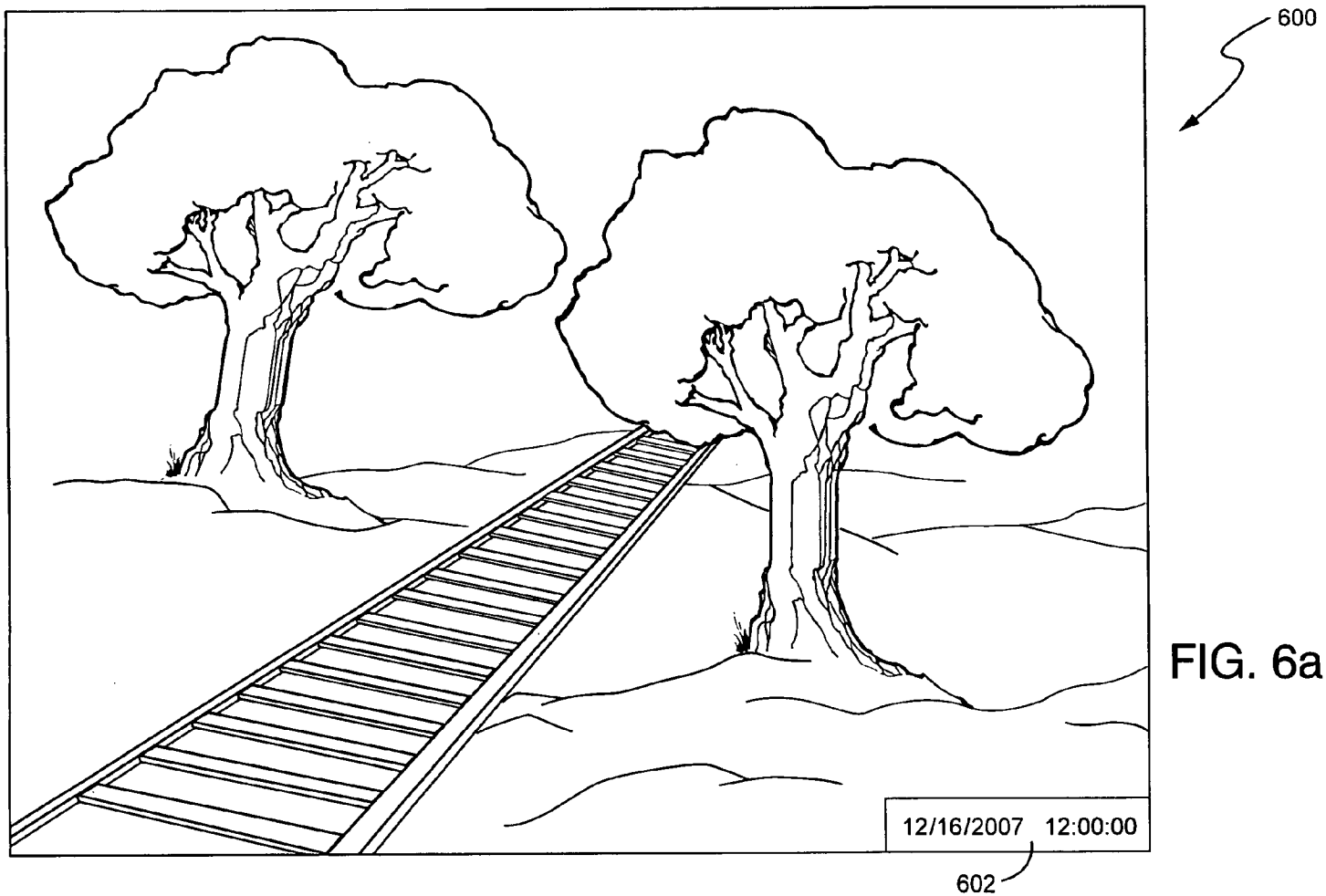
FIG. 6*a* is an illustrative display showing condition data associated with a monitored area of a railway in accordance with an example embodiment.

FIG. 6*a* is an illustrative display 600 showing condition data associated with a monitored area of a railway in accordance with an example embodiment. Display 600 also shows a date/time 602 at which the capture was taken. As noted above, display 600 may show condition data received by approaching trains from a sensor 10 located at or proximate to a monitored area. Display 600 may include other information, such as, for example, estimated time to reach the area, temperature information (relevant because heat may cause track deformation, which has been known to lead to derailments), etc., and the information may be displayed on one or multiple screens and/or readouts or gauges. It will be appreciated that display 600 may be updated as new condition data is received. Also, it will be appreciated that if condition data from multiple sensors 10*a-n* are received, the image may switch between the condition data (e.g. rotating images in a given order, etc.). In the particular example shown in FIG. 6*a*, a railway is clear of any obstructions, indicating to a conductor that it is safe to proceed along its course.

Figure 6B:
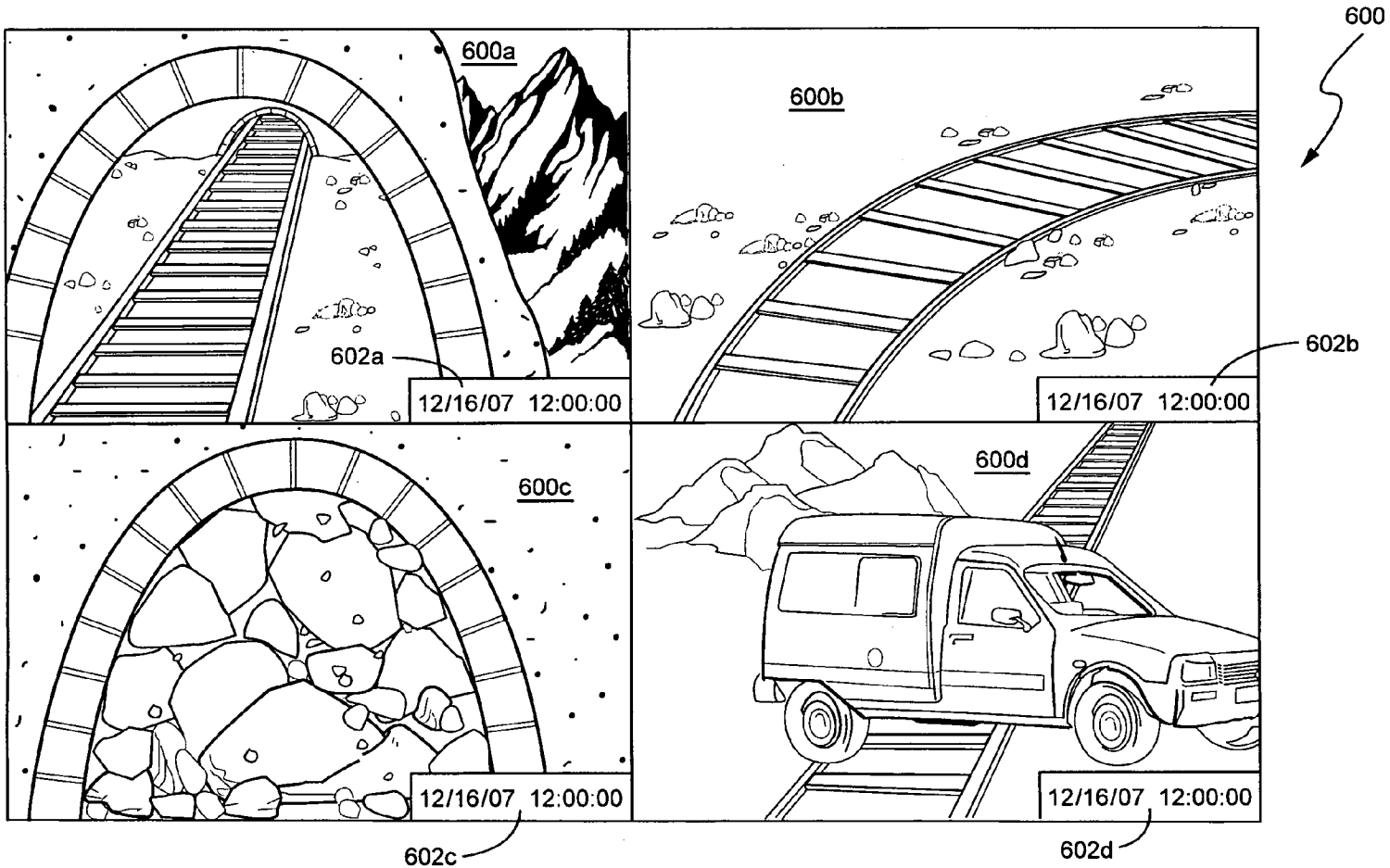
FIG. 6*b* is an illustrative display showing condition data associated with several monitored areas of a railway in accordance with an example embodiment; and, FIG. 7 is an illustrative flowchart showing an example process for monitoring areas of a railway in accordance with an example embodiment.

FIG. 6*b* is an illustrative display 600 showing condition data associated with several monitored areas of a railway in accordance with an example embodiment. Display 600 is divided into four sections 600*a-d*, representing condition data from four monitored areas. Of course, the number of sections in, and the orientation of, the display 600 are provided for illustrative non-limiting purposes only. Each section 600*a-d* includes a corresponding date/time 602*a-d* at which the capture was taken. The condition data shown in the sections of display 600 may be ordered, for example, from left-to-right and top-to-bottom. In the particular example shown in FIG. 6*b*, a railway is clear of any obstructions when entering a tunnel in section 600*a*. Similarly, there are no problems at the sharp bend shown in section 600*b*. However, in section 600*c*, a cave-in has obstructed the exit to the tunnel. In section 600*d*, a car is shown blocking a particular stretch of track. Based on such illustrative information, a hypothetical conductor could alter the train's course or could take steps to reduce the impact of an unavoidable accident (e.g. by reducing speed in advance of a collision). It will be appreciated that the monitored areas shown in connection with FIG. 6*b* are to be taken by way of example, and without limitation.

Figure 7:
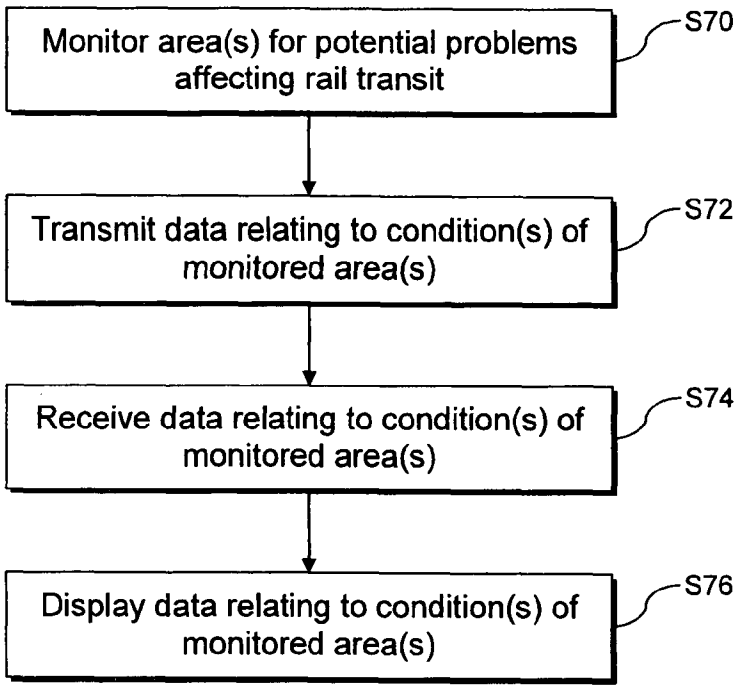

FIG. 7 is an illustrative flowchart showing an example process for monitoring areas of a railway in accordance with an example embodiment. In step S70, one or more areas are monitored for potential problems that might affect railway operation. As noted above, the sensors that derive data to be included in the condition data may take many forms to capture many types of data, such as, for example, one or more of video images with or without sound, image captures (e.g. taken at predetermined rates), motion detectors, pressure sensors, thermometers, etc. In step 72, data relating to the condition of the monitored areas may be transmitted (e.g. wirelessly, through a wired communication, through a rail, etc.). In certain example embodiments, the condition data may be broadcasted, whereas certain other example embodiments may direct condition data to specified trains, a central location, etc.

Data relating to the condition of the monitored areas may be received by one or more trains in step S74. In certain example embodiments, a train may receive all data within its communication range, regardless of the track on which it is traveling. Optionally, the condition data may be filtered based on distance, time of approach, etc., by a system on the train, by a central location, etc. Data relating to the condition of the monitored areas may be displayed in step S76. The data may be ordered, displayed on multiple displays (e.g. on multiple physical units, on a single, partitioned unit, etc.), etc. Optionally, in a step not shown, data relating to the train's location may be sent to the monitored area and displayed to notify others of the train's status (e.g. a time at which the train will arrive, etc.).

Another example advantage associated with certain example embodiments of this invention is to prevent or reduce the likelihood of terrorist attacks. In particular, certain example embodiments of this invention would make it more difficult for terrorists to damage or destroy a train carrying flammable materials or the like.

While the foregoing example embodiments have been described in detail with reference to a single approaching train, it will be appreciated that such example embodiments may easily be modified to encompass the complicated railway systems in which multiple trains run. For example, certain example embodiments may be configured for a railroad system in which multiple trains pass through multiple monitored areas, with each monitored area having multiple sensors located therein.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for reducing problems associated with a railroad system, comprising:

a sensor system comprising a plurality of sensors, the sensor system being operable to gather condition data related to a plurality of monitored areas, each sensor being associated with one said monitored area and at least one said monitored area comprising a crossing where a train track intersects with a road for vehicles, said condition data comprising an optical video or an image of the monitored areas, and a temperature of the monitored areas;

wherein the optical video or the image, and the temperature are obtained via separate and independent sensors of the sensor system such that the sensor used to obtain the temperature is not used to obtain the optical video or image, and vice versa, wherein each sensor has an associated first communicator configured to communicate with one or more second communicator(s), each second communicator being located on a train;

wherein each train includes a display operable to display said condition data received by the second communicator associated with the train; and wherein a processor is operable to filter condition data based on a location of the train relative to the monitored areas and/or a determination of when the train is scheduled to reach the monitored areas, so that the display is caused to display only a partial subset of the received condition data.

2. The system of claim 1, wherein each sensor is operable to gather condition data at predetermined time intervals.

3. The system of claim 1, wherein the condition data further comprises a date and/or time associated with when the condition data was gathered, and an identifier for identifying the monitored area from which the condition data was gathered.

4. The system of claim 1, wherein each train further includes a unit operable to determine a location and/or speed at which the train is traveling.

5. The system of claim 4, wherein the unit comprises a GPS unit.

6. The system of claim 1, wherein a processor is operable to order condition data received from two or more sensors based on a location of the train relative to the monitored areas and/or a determination of when the train is scheduled to reach the monitored areas.

7. The system of claim 1, wherein a second display located proximate to one said monitored area is operable to display a time at which a train will arrive at that monitored area, a length of time during which the train will be passing through that monitored area, and/or a countdown until the train will arrive at that monitored area.

8. The system of claim 1, wherein each first communicator and each second communicator is a wireless communicator.

9. The system of claim 1, further comprising a central safety station operable to communicate with each first communicator and each second communicator.

10. The system of claim 9, wherein the central safety station is configured to relay condition data to a second communicator from a first communicator based on a location of the train relative to the monitored areas and/or a determination of when the train is scheduled to reach the monitored areas.

11. The system of claim 1, wherein the display is further configured to display one or more suggested mitigation plans in the event that the condition data suggests that there is a problem with the monitored areas.

12. A method for reducing problems associated with a railroad system, the method comprising:

gathering, via a plurality of sensors provided to a sensor system, condition data for a plurality of monitored areas, said condition data comprising an optical video or an image of the monitored areas, and a temperature of the monitored areas;

sending the condition data to any trains within a receiving range; and when a train is within a receiving range of the condition data, causing the condition data to be received by the train and causing the condition data to be displayed on the train based on predetermined criteria, the condition data gathered from two or more sensors and being displayed in an ordered manner based on a location of the train relative to the monitored areas and/or a determination of when the train is scheduled to reach the monitored areas;

wherein the optical video or the image, and the temperature are obtained via separate and independent sensors of the sensor system such that the sensor used to obtain the temperature is not used to obtain the optical video or image, and vice versa.

13. The method of claim 12, wherein condition data is gathered at predetermined intervals.

14. The method of claim 12, wherein the condition data comprises a video and/or an image of the monitored areas, a date and/or time associated with when the video and/or image of the monitored areas was gathered, and an identifier for identifying the monitored areas.

15. The method of claim 12, further comprising determining a location and/or speed at which the train is traveling.

16. The method of claim 12, wherein the condition data is filtered based on a location of the train relative to the monitored areas and/or a determination of when the train is scheduled to reach the monitored areas such that only a partial subset of received condition data is displayed.

17. The method of claim 12, further comprising causing the display of a time at which a train will arrive, a length of time during which the train will be passing through, and/or a countdown until the train will arrive, at a location proximate to the monitored areas.

18. The method of claim 12, further comprising sending all condition data to a central safety station, the central safety station being operable to determine whether the condition data should be send to a train based on the predetermined condition.

19. The method of claim 12, further comprising causing one or more suggested mitigation plans to be displayed on the train in the event that the condition data suggests that there is a problem with the monitored areas.

* * * * *